US005356482A

United States Patent [19]

Mehta et al.

[11] Patent Number: 5,356,482

[45] Date of Patent: Oct. 18, 1994

[54] PROCESS FOR VESSEL DECONTAMINATION

[75] Inventors: Nishaneth K. Mehta; Richard W. Krajicek, both of Houston, Tex.

[73] Assignee: SERV-Tech, Inc., Houston, Tex.

[21] Appl. No.: 998,556

[22] Filed: Dec. 30, 1992

Related U.S. Application Data

[63] Continuation-in-part of Ser. No. 805,367, Dec. 10, 1991, abandoned.

[51] Int. Cl.[5] ..... B08B 3/00; B08B 9/00

[52] U.S. Cl. ..... 134/22.1; 134/22.14; 134/22.15; 134/22.19; 134/10; 134/30; 134/31; 134/34; 134/11; 134/39

[58] Field of Search ..... 134/22.1, 22.14, 22.15, 134/30, 31, 11, 22.19, 34, 10, 39

[56] References Cited

U.S. PATENT DOCUMENTS

| | | | |
|---|---|---|---|
| 1,722,211 | 7/1929 | Guardino | 134/22.15 |
| 1,891,592 | 12/1932 | FitzGerald | 134/31 |
| 2,023,496 | 12/1935 | Todd | 134/22.15 |
| 2,715,594 | 8/1955 | Garrison | 134/22.15 |
| 3,084,076 | 4/1963 | Loucks | 134/22.15 |
| 4,446,044 | 5/1984 | Rutkiewic et al. | 252/DIG. 14 |
| 4,511,488 | 4/1985 | Matta | 252/162 |
| 4,790,951 | 12/1988 | Frieser et al. | 252/162 |

OTHER PUBLICATIONS

"Benzene Carcinogenicity," CRC Press, Inc., Boca Raton, Fla.

Oak Ridge National Laboratory, "Toxicological Profile for Benzene," (May 1989).

*Primary Examiner*—Richard O. Dean
*Assistant Examiner*—Zeinab El-Arini
*Attorney, Agent, or Firm*—John R. Kirk, Jr.

[57] ABSTRACT

An improved process for the decontamination of process equipment and vessels is described wherein an extractant material for the contaminant and a surfactant are vaporized, heated with steam, to condense on the internal surfaces of the vessel to trap contaminants, such as benzene, for removal from the vessel to allow safe entry for humans for inspection and maintenance.

22 Claims, No Drawings

PROCESS FOR VESSEL DECONTAMINATION

This is a continuation-in-part application of Ser. No. 07/805,367, entitled "Process for Decontamination of Process Vessels," filed Dec. 10, 1991, abandoned.

FIELD OF THE INVENTION

This invention relates to the cleaning of process equipment and vessels to remove contaminants, particularly benzene, during turn-around periods making it safe for personnel to enter the vessel for maintenance and repair. Specifically, it involves an improvement in the process for using steam acids alkalies or wetting agents to decontaminate the vessels.

BACKGROUND OF THE INVENTION

In the chemical process and petroleum refining industries, maintenance and often capital improvements of process plants occur on a scheduled basis, either annually, biannually, or less often, if possible, at scheduled times when the operating unit is completely shut down and every aspect of its operation inspected and maintained. Operating units are made up of various types of vessels from tanks to heat exchangers to distillation columns, catalytic reactors and the like. This massive maintenance effort on each unit is called a turnaround and maximum speed in getting the unit back on stream is the order of the day, since the main cost of such an operation, even though extensive, is the time during which this operating unit is not producing product or refining petroleum, which can be sold. The speed at which the jobs are done are, of course, tempered with the necessity that safety of the workers be maintained throughout the operation.

During a turnaround, an operating process vessel cannot merely be shut down and drained before entry of maintenance and repair crews. The vessel must first be rendered safe and decontaminated of any residual material in it which may be harmful, even fatal, to the workers who must enter to inspect and maintain, if not refurbish, the internal structure of the vessel. The present practice, depending upon the vessel, is to inject steam for a period of time until monitoring devices indicate that no dangerous gases remain which present an explosive hazard to workers who must work in this environment. Vessels are also washed with water to remove contaminants where applicable, and often, both steaming and water washing is involved in the degassing of a vessel to make it possible for humans to safely enter to inspect and repair. Hazardous contamination of process vessels may also come from auxiliary pieces of equipment which are attached in fluid communication such as, for example, various kinds of heat exchangers and demister pads. This problem has been made much more difficult in view of the present concern that the hazardous materials removed from the vessel being cleaned become an environmental problem, either through release to the atmosphere or through improper disposal of wash water containing the waste. The previous attempts at steaming were just that, attempts, and often required long periods of time, days even, before the "sniffers" indicated the contaminant had been either removed or reduced to such a minuscule presence that the vessel was safe for entry. Water washing results in an inordinate amount of liquid waste for which disposal must be accomplished.

Of particular importance is the removal of benzene and other volatile organic carbons from the process vessels. It has been long recognized that chronic exposure by humans to benzene at high levels in the chemical and petrochemical work place leads to bone marrow depression, aplastic anemia, and leukemia. Although absorption of benzene across the skin as a vapor or in aqueous media is minimal, benzene toxicity is most frequently caused by inhalation of benzene through the respiratory system. Present government safety standards for eight hour work days are set at 1.0 ppm (average) benzene. The National Institute For Occupational Safety And Health (NIOSH) has recommended (1989) an occupational long term exposure limit in air of 0.1 ppm benzene. That is not good enough since workmen involved in cleaning process vessels are exposed on a year-round basis to the interior of these vessels. The goal of the present invention, therefore, is to provide a process for vessel decontamination which exceeds this standard—in fact, which approaches, if not meets, 0 ppm of benzene. Benzene can be trapped beneath scale or other contaminants only to seep out at a later time when cleaning had been considered completed or gather in the head space of the vessel.

Even though there are many conflicting problems which converge on the process vessel, still, the overriding requirements are speed with safety, and the practice of this invention over the present practice accomplishes these while providing avenues for a more effective protection of the environment. This invention allows almost pristine cleaning of process vessels without even opening them in many cases until safely decontaminated of dangerous substances, such as benzene.

SUMMARY OF THE INVENTION

This invention involves an improvement over the old methods of steam cleaning process equipment and vessels to decontaminate them, particularly for benzene removal, to allow human entry for inspection and repair by incorporating into the steam an extractant which is a vapor at the steam conditions, having an affinity for the material being removed, such that the steam and the extractant will condense on the inside surfaces of the vessel to remove and trap the contamination. It is preferred that a surfactant which boils or having a high vapor pressure within the same temperature parameters also be included with the steam to enhance the wash down of the tower skin and internal surfaces with both condensed water and extractant. On process vessels such as distillation columns and reactors, the steaming operation can occur without venting gases to the atmosphere from the vessel and leaving but a small volume of liquid materials to be removed from the vessel after decontamination for entry is completed.

The extractant material is chosen based upon its boiling point and vapor pressure and the known solubility of the contaminant in the extractant. Even if the surfactant and extractant do not boil in the temperature range of the steam, if the partial pressure of these two components is sufficiently high at cleaning conditions, the material will be dispersed throughout the vessel and will condense in the interstices of the metal and matrix of hydrocarbon scale to assure extraction and removal of the contaminants, especially benzene. Condensation of the vapors in the closed vessel creates sufficient vacuum to extract the contaminants from the interstices and break down the scale particle. In the event other gases are present, such as, for example, hydrogen sulfide, a scavenger material for the hydrogen sulfide would also be used, such as, for example, an alkanolamine.

In one embodiment of this invention, the steam is injected into the vessel until a pressure of from about 20 to about 60 psig is reached. Injection is stopped and the tower is held to allow condensation to occur on the internal surfaces. The condensed steam, extractant and surfactant, when used, condense on the internal surfaces to flow down the surface carrying trapped contaminants forming a pool of condensed liquids and chemical residue contaminating the vessel. This pool of condensed liquid is removed and the vessel tested to determine whether levels of contaminants are such that entry by humans would still be unsafe. If such is the case, the steps are repeated.

As a preferred embodiment, when the vessel to be decontaminated is a distillation tower, either with trays or packing, or similarly fitted reactors, a cascading method is used to produce agitation of the solution against the contaminated surfaces, as opposed to the flowing condensed liquids mentioned above, to clean the tower where a pool of water is circulated from the bottom of the tower and discharged back into the top. Thus, the pool of liquid flows through the tower cascading down over the trays or through the packing, contacting the surfaces of the tower with extractant, surfactant and water mixture. The pool of liquid is recycled through the circulation loop at an optimum flow rate based upon the tower design for flooding the trays or tower packing. The skilled engineer can easily determine such rates for a given tower. In the practice of this invention a circulation rate from of about 800 to about 1400 gallons per minute is used, preferably about 1000 GPM with simultaneous injection of steam to the base of the vessel to heat the circulating water. As described above, steam condenses on the internals in the tower as well as heating the water. Once the water temperature reaches from about 160° F. to about 230° F., preferably, from about 185° F. to about 210° F., the extractant and surfactant materials are injected into the water circulation loop or in the steam injection stream, or both. Circulation, with steam injection, is continued from about two to about eight hours, preferably from about four to about six hours, at a preferred temperature of about 185° F. As described before, the circulation is stopped and the tower is rinsed with fresh water and tested for unsafe contamination. Auxiliary equipment such as heat exchangers and tube bundles are also decontaminated by circulation of the hot water, extractant, and surfactant system of the invention.

DETAILED DESCRIPTION OF THE INVENTION

In a turnaround situation in the cleaning of process vessels, it is not uncommon that the vessel is contaminated with residual amounts of carcinogens such as benzene, xylene, toluene, and other hydrocarbons, both aromatic and aliphatic. Further gases may be present, such as hydrogen, which is explosive, and hydrogen sulfide, which is a deadly poison. The presence of these gases is detected with various devices and limitations have been set by health and environmental standards as to what amounts can be safely contacted by humans or what amounts can be safely released to the environment, respectively. Thus, these materials must be removed before work and maintenance crews can safely enter the vessel. The vessels are all normally equipped with attachments where steam at a temperature of from about 212° F. to about 375° F., preferably from about 215° F. to about 350° F., may be introduced for periods of time to condense on the internal surfaces within the vessel and apparatus to wash it to the bottom where the contaminant and wash fluid is removed. Additional washing is often necessary with water and surfactants to gather up residual contaminants. It is this process of steam decontamination that is improved by the process of this invention. This improvement is brought about by introducing with the steam used to clean the tower a fog of an extractant, preferably accompanied by a surfactant. The extractant can be introduced into the tower with the steam or fogged into the vessel where it is then vaporized in the steam and carried up into the vessel where it condenses along with the steam and trickles down the inside of the vessel, agitating the solution against the contaminant while flooding the internals and thus removing the contamination.

In the alternative, the extractant may be introduced into the steam and injected into a packed tower or a trayed tower while water is being circulated over the tower. Yet another alternative is to collect water in the bottom of the tower and circulate it over the tower while injecting steam to heat the circulating water to a temperature of from about 160° F. to about 230° F., preferably from about 185° F. to about 210° F., and then adding the extractant to the circulating water to obtain a concentration of from about 1½% to about 5% by volume.

The extractant is chosen to correspond to the contaminant being removed. The criteria for selection are the solubility of the material being removed in the extractant, the vapor pressure and the boiling point of the extractant such that it is within the range of the temperature of the steam and will condense on the surfaces of the metal and in the interstices in the metal, preferably prior to the condensation of the steam, such that the water condensate, as it trickles down, washes the internal surfaces of the vessel. For example, satisfactory extractants would include materials such as limonene and other like materials, preferably the various terpenes including for example dipentenes, cinenes, cajeputenes, diamylenes, the oils of bergamot, geranium, citronella, dill, and caraway, and the like and related terpenes such as hermiterpenes (isoprenes), sesquiterpenes (caryophyllenes), diterpenes, and polyterpenes. The extractant material should be non-toxic and non-hazardous and selected such that it has a high vapor pressure or boiling point within the range of the steam available at the particular plant for use, when injection with the steam is to be practiced, preferably within the range of from about 212° F. to about 375° F., preferably from about 275° F. to about 350° F. Thus, the partial pressure of the extractant will be significant at cleaning conditions. Mixtures of several extractants may be used satisfactorily with the same criteria as set forth above. Simple experimentation is all that is necessary to select the mixture and relative proportions.

The matter of selecting the satisfactory surfactant is also within the range of one skilled in the art. The boiling point and vapor pressure criteria remain the same, i.e., up to about 375° F. such that the surfactant will also condense at substantially the same time as the steam and the extractant material condenses. This allows the cracks and crevices of the metal and tower internals, including the matrix of scaley contamination, to all be invaded by the components of this cleaning system to break down the scale and trap the contaminants into the solution (microemulsion) and remove the troublesome contaminants, especially benzene. The selected surfactants may be anionic, cationic, amphoteric or non-ionic, or mixture from several classes, but the selection specifically is within the experience of the skilled chemist, based upon the material being removed as the contaminant, the extractant being used and the relative amounts which are expected to be taken up into the wash from the condensing steam or subsequent water wash of the vessel, which, in the practice of this invention, should be substantially diminished over previous washing operations. The HLB (Hydrophile/Lyophile Balance) of the surfactants selected should be between 6 and 18 and preferably, between about 7.5 and 12 for the optimum results in the practice of this invention. The characteristics of the members of these classes of surfactants are well known as are the many compounds within these classes. Mixtures of surfactants in several of the classes mentioned above may be used successfully, especially in the situation where a premix of extractant and surfactant is used. This premix would normally be in the form of a microemulsion with several extractants and surfactants being brought together to prepare the mix. Often, several surfactants would be necessary in order to give the mixture a shelf life as a homogenous fluid, usually as a microemulsion. Such a mixture would be injected in an amount of from about 0.2 to about 0.4 pounds per pound of steam, preferably from about 0.25 to about 0.33 pounds per pound of steam. When added to circulating liquid the amount would result in an effective amount being present, usually a concentration from about 1½% to about 5%, preferably from about 2% to about 4%.

In performing the process of this invention from about 0.06 pounds to about 0.3 pounds, preferably from about 0.1 pounds to about 0.20 pounds, of the extractant per pound of steam should be introduced. Likewise, the surfactant should be introduced in the ratio of from about 0.001 pounds to about 0.01 pounds, preferably from about 0.003 pounds to about 0.005 pounds, per pound of steam. When both the extractant and surfactant are present, they are present in a ratio of from about 0.5 to about 30 pounds, preferably from about 1.5 to about 10 pounds, of extractant per pound of surfactant. As has been said previously, all of the materials may be introduced simultaneously with the steam or any one introduced with the steam with either other or both of the extractant and surfactant being picked up by the steam within the tower, vaporized and transported up the vessel with the steam until condensed. The steam and extractant can be premixed prior to injection into the vessel or injected at separate points in the vessel. Likewise, the extractant, surfactant and steam, all three may be premixed prior to injection into the vessel. Many vessels, notably catalytic cracking units and distillation columns, include reflux systems and demister pads of woven strands of metal at the upper end of the tower, which must also be decontaminated. By carrying the extractant/surfactant steam mixture of this invention upwards through the vessel with condensation occurring at or near the top and even in the reflux equipment itself, the entire tower can be contacted and flushed through the practice of this invention, leaving only the liquid residue at the bottom of the tower for removal. Similarly, when the embodiment involving use of circulating the solution of extractant and surfactant through the trays and/or packing of a tower while, or after, steaming only a relatively small amount of water microemulsion containing the contaminants remains for disposal while a safe, clean tower is available. Once the residue is removed from the tower the interior can be tested with the normal sensing equipment to determine whether it is safe for work crews to enter. If not, then further steaming can occur or a wash down using water, preferably accompanied by additional surfactant as known to those skilled in the art may be practiced. After the practice of either of these modes of operation for closed decontamination of process vessels, entry by workers for inspection, maintenance and repair may be accomplished.

In one embodiment of this invention, the steam is injected into the vessel until a pressure of from about 20 to about 60 psig is reached. Injection is stopped and the tower is held to allow condensation to occur on the internal surfaces. The condensed steam, extractant and surfactant, when used, condense on the internal surfaces forming a pool of condensed liquids and chemical residue contaminating the vessel. This pool of condensed liquid is removed and the vessel tested to determine whether levels of contaminants are such that entry by humans would still be unsafe. If such is the case, the steps are repeated.

In another embodiment, a cascading, or circulation, method is used to clean the vessel. The closed vessel, usually a packed tower or trayed distillation column is first partially filled with water sufficient to wet packing or fill trays and still leave the pump intake covered when circulating, usually about 8% to 15% of the tower volume. A water circulation loop is provided by connecting a line from the bottom of the vessel to the top of the vessel. This loop allows the water to flow down through the packing or over trays in the vessel, be suctioned from the bottom, and pumped upward for discharge again to the top of the vessel. The water is recycled through the circulation loop at a rate sufficient to flood packing or fill the trays, preferably about 1000 GPM, with simultaneous injection of steam to the base of the vessel. Once the water temperature reaches about 185° F., an effective amount of the extractant and surfactant materials are injected into the water circulation loop. Circulation is continued for about three hours at a temperature of about 185° F. or higher. As discussed previously, the circulation or agitation, is then stopped, the circulating liquid collected in the bottom of the tower or removed, and the vessel is rinsed with fresh water. Again, the vessel is tested prior to entry.

By the practice of this invention, substantial time savings can be made which enhances the results of the cleaning, as well as allowing the vessel to be put back on stream sooner, resulting in a substantial savings to the owner of the facility, as well as safely accomplishing the cleaning. As a particular advantage, the vessels are free from volatile organic compounds (VOCs), especially benzene which is a known carcinogen. Under prior attempts at decontamination, workmen could detect benzene by smell after a period of time spent working in the vessel. The VOCs would collect in the head space of the vessel where they could later be purged to the atmosphere. That purging is no longer possible under present environmental standards. Using the method of this invention, the benzene odor never reoccurred and testing of a tower or other equipment with instruments indicated undetectable levels of benzene or other VOCs without purging the dangerous materials to the atmosphere.

For example, a preferred mixture of extractants and surfactants for cleaning a reaction vessel was prepared using the following components:

TABLE I

| (Mixture A) | Weight Percent |
|---|---|
| D. Limonene | 57% |
| Pluronic 10R-5[1] | 9% |
| Monamulse 653-C[2] | 17% |
| Butyl Cellusolve | 3% |
| Macon 10[3] | 5% |
| Water | 9% |
| | 100% |

[1]Block copolymer of ethylene oxide and propylene oxide having a molecular weight of 1950 and HLB of 12 to 18 - BASF, Parsipanny, NJ.
[2]90% active ingredients of a 50/50 mixture of an alkanolamide of a fatty acid and an alkanolamine and a linear alkylbenzene sulfonic acid in 10% isopropanol, b.p. 205° F. - Mona Industries, Chicago, IL.
[3]10 mole ethylene oxide adduct of a nonlyphenol - Stepan Chemical, Northville, IL.

In another embodiment (Mixture B), the 8% represented by the butyl cellusolve and the "Macon" 10 in the mixture is replaced by "Igepal" CO 530, which is a 6 mole ethylene oxide adduct of nonylphenol ethoxylate with an HLB of 10.8. (Rhone-Poulenc).

The above-identified components, when mixed together, form a stable microemulsion having a long shelf life and exhibiting good solvency for oils or greases, including the lighter materials such as benzene, toluene, and xylene which are trapped and held by the microemulsion until removed from the vessel in spite of the elevated temperatures at which the cleaning is performed. In the cleaning of a tower, either microemulsion described above is injected with steam into the tower at a rate of 1 pound per 3 to 4 pounds of steam. The injection is continued until the tower is cleaned, the amount of surfactant/extractant and steam being determined by the size of the tower and the degree of contamination in it.

The following examples are introduced to illustrate further the novelty and utility of the present invention but not with the intention of unduly limiting the same.

EXAMPLE 1

This example describes decontamination of a naphtha splitter tower to allow entry for maintenance on the tower internals. Excess liquid hydrocarbon was first flushed from the tower with fire hydrant water. The tower was then filled to 10% volume with water.

A filter/pump trailer was connected to the tower, taking suction from the bottoms removal line of the tower, and discharging to the top tray of the tower, to provide a continuous, recycled cascade effect through the tower. Circulation of the water was commenced at 1000 GPM to cause agitation between the solution and surface with simultaneous steam injection at the base of the tower using steam available at the refinery. Once the water temperature reached 185° F., the decontamination mixture of the present invention (Mixture B, above) was injected into the water loop to provide 2.0% concentration. Circulation was continued for 3½ hours, while holding the temperature at 185° F.

The circulation was then stopped and the liquid containing hydrocarbon scale and contaminants was pumped directly to refinery "slops" storage. The tower was rinsed twice with water and again all contaminated water was pumped to the slops. The tower was refilled to 10% volume with water, the cleaning Mixture B was again added to provide a 2.0% solution, and the circulation stage was repeated for 3½ hours. As before, all "spent" solution and rinse water was pumped to slops.

The bottom connections were opened and a large amount of heavy debris was flushed from the bottom of the tower, and removed by a vacuum truck. From commencing circulation to completing the final flush to drain the safe decontaminated naphtha tower took only 17 hours.

When the tower was opened by refinery personnel for inspection, they declared it to be gas free, hydrocarbon free and cleaner than under any previous decontamination procedure. Internal work could commence immediately. Including setting-up and disconnecting and removal of the filter/pump trailer, the whole project had taken only 24 operating hours.

EXAMPLE 2

Decontamination was performed on a Visbreaker Tower which was 5'6" in diameter and 62' high, containing 23 trays with bubble cap design. Approximately 2800 gallons (25% of tower volume) of water at 180° F. containing 3.0% of cleaning Mixture B was circulated for 8 hours through the whole tower using a filter truck connected to the tower as described in Example 1 above. Samples of the circulating water were collected at 1 hour intervals, to test how well the emulsification of the contaminants in the tower was progressing. After 8 hours, the spent solution from the tower was removed and hauled to a portable tank by a vacuum truck. The tower was then rinsed with fresh water and the rinsed water was also carried away to the portable tank by a vacuum truck. A tower manway was opened immediately upon completion of the rinse cycle. The tower was inspected and it appeared to be clean to bare metal. Inside tower walls, upon touching, felt grease-free and hydrocarbon-free. The next morning, refinery personnel inspected the tower and declared it safe for entry. There was neither odor of any hydrocarbon present nor detectable amounts by instruments.

EXAMPLE 3

This example describes cleaning a heat exchanger bundle which had Visbreaker bottoms on the shell side and crude oil on the tube side. A 27'×8'×9.6'"vat" was built and fitted with steam and air lines to clean the bundle. This is an auxiliary heat exchanger to the Visbreaker tower described in Example 2.

The "vat" was filled with approximately 8000 gallons of water. Steam was injected into the water via a steam line until the water temperature reached about 180° F. Four drums of cleaning Mixture B were added to the "vat" to make approximately 3% solution.

The bundle had a heavy coat of viscous tar and coke on the shell side. In some places, the build up was about 3" to 4" thick. The pulled bundle was then placed in the "vat" containing hot 3% aqueous solution described above. The "vat" was covered with a tarpaulin (to avoid atmospheric pollution) and an air line was connected to the vat and turned on to provide agitation. Foaming occurred and the air line was turned off. The bundle was soaked in the vat without agitation for 8 hours. After 8 hours, the bundle was taken to the hydroblast pad for hydroblasting with high pressure water.

Hydroblasting of the bundle revealed that the top layer of the foulant came off easily but that the coke layer between and on the tubes prevented penetration of the cleaning mixture and hence the viscous tarry foulant between the tubes was not emulsified by the cleaning mixture solution. The old, (i.e., the first) 3% cleaning mixture solution was completely spent during the first soaking cycle.

The bundle was soaked again for 4 hours in a fresh 3% solution of cleaning Mixture B. The second soaking of the bundle helped greatly because the cleaning mixture solution could now penetrate the scale, break down the hydrocarbon matrix and emulsify the tar between the tubes. Subsequent hydroblasting helped remove the previously impervious coke layer. It took approximately 1½ to 2 days to clean the bundle, which normally takes up to 8 days. Refinery personnel were pleased with the results.

EXAMPLE 4

The liquid circulation tubes of two finned fan coolers were connected in series and the volume of the tubes was calculated to be about 2000 gallons. A holding tank (Baker) was filled with approximately 3000 gallons of water and a steam line was hooked up to the tank. The water in the tank was heated to 180° F. and approximately 1½ drums (about 80 gallons) of the cleaning Mixture B was added to the tank. The solution thus made (about 2.75% of the cleaning mixture) was circulated through the tubes of the in fans connected in series for 6 hours at a temperature of about 180° F. The solution was drained back into the tank after circulation. Fresh water from a fire hydrant was used to rinse the fin fans. Discharge ports of the fin fans were inspected and looked very clean. Again, the refinery personnel were very pleased with the job. Two additional fin fans were cleaned on a later date, in the same manner, with excellent results. No hydrocarbon fouling was observed.

EXAMPLE 5

This example relates to a successful decontamination of a complete hydrocracker process system at a refinery. The hydrocracker process system which was decontaminated consisted of the following ten units plus all the heat exchangers and piping associated with the units:

1) First stage reactor feed
2) Second stage reactor feed/effluent
3) Stabilizer Overhead
4) Splitter Tower
5) $H_2S$ Stripper Tower
6) Feed Surge Drum
7) Splitter Overhead Accumulator
8) Low Pressure Separator
9) $H_2S$ Stripper Overhead
10) Stabilizer Tower Each of the above units were decontaminated following applicable steps of the previous examples using 1.0% of cleaning Mixture B, which was circulated for about 6 to 8 hours at 180° F. The units were then drained and rinsed with fresh water. The spent solution and rinse water were sent to a holding tank where it was disposed of with other refinery waste water.

Upon opening, each of the above-mentioned units were found to have no detectable benzene. After the decontamination process, the $H_2S$ Stripper Tower, Overhead Accumulator, and Stripper Tower not only had zero benzene but also had zero $H_2S$ and very little FeS sludge at the bottom. The refinery personnel were very pleased with the results.

In the $H_2S$ Stripper Tower and first stage reactor feed/effluent, sodium carbonate was added to the circulating 1% solution of Mixture B to neutralize any acid that may have been present.

There were 10 free standing pumps with separate filter units to circulate the Mixture B solution. Each unit was treated individually. Some of the larger units, e.g., Stabilizer Tower (162' high) and the Stripper Tower (162' high) used 3 free standing pumps and reflux pumps on the tower to circulate the Mixture B solution.

Having described the foregoing invention as set forth above, those of ordinary skill in the art now are in a position to practice such invention and determine easily the components and parameters for use therein, and may make many modifications and changes of the above-described invention without being outside the scope of the claimed invention.

What is claimed is:

1. A process for decontaminating process vessels and auxiliary equipment in fluid communication therewith to remove benzene and hazardous solid, liquid and gaseous chemical contamination to permit entry by humans into the vessel to perform maintenance and repair comprising the steps of:

contacting solid and liquid contamination on vessel surfaces, at a temperature of from about 160° F. to about 230° F., with an aqueous solution containing a terpene extractant chemical and a surfactant having an HLB of from about 6 to about 18;

circulating the solution through the process vessels in contact with the surface to allow invasion of interstices of solid contaminants by the surfactant and extractant for a time sufficient to break down, separate and entrap such contaminants into the solution;

dispersing such extractant and surfactant as vapor through the process vessels to condense on surfaces of the vessels to break down scale and trap contaminants; and separating the solution from the surface to remove the benzene and contaminants from the vessel with the fluid.

2. The process of claim 1 which includes the step of:

circulating the aqueous solution for from about 1 to about 8 hours.

3. The process of claim 1 which includes the steps of:

halting the steam injection when the pressure within the vessel reaches from about 20 to about 60 psig; and holding the steam within the vessel for a time sufficient to allow the condensation to occur.

4. A process for removal, sufficient to allow human entry into a vessel for repair and maintenance, benzene contamination from a vessel which has been taken out of service and drained, comprising the steps of:

injecting into the vessel, for a period of time sufficient to reduce benzene contamination by presence of chemical residues to allow safe exposure to humans, steam at a temperature of up to about 375° F.;

injecting into the vessel, in the presence of the steam, from about 0.06 pounds to about 0.3 pounds per pound of steam of a terpene extractant for the chemical residue in the vessel having a boiling point of up to about the temperature of the steam being injected;

injecting into the vessel, as an optional component in the presence of the steam up to about 0.2 pounds per pound of steam of a surfactant having an HLB of from about 6 to about 18, provided, however, when both the extractant and surfactant are present, they are present in a ratio of from about 0.5 to about 30 pounds of extractant per pound of surfactant;

allowing steam, extractant and surfactant to condense on internal surfaces within the vessle and invade interstices of scale on the surface to extract and trap benzene contaminants and form a pool of condense liquids and chemical residues; and removing the condensed liquid and chemical residue from the vessel.

5. The process of claim 4 which includes the steps of:

restricting exit of steam from the vessel while condensing the steam, extractant and surfactant.

6. The process of claim 4 wherein from about 0.06 to about 0.3 pounds of extractant per pound of steam and from about 0.001 to about 0.01 pounds of surfactant are injected per pound of steam.

7. The process of claim 4 wherein the steam and extractant are premixed prior to injection into the vessel.

8. The process of claim 4 wherein the steam and extractant are injected at separate points into the vessel.

9. The process of claim 4 wherein the extractant, surfactant and steam are premixed prior to the injection into the vessel.

10. The process of claim 4 wherein the steam has a separate injection point from that of the extractant and surfactant.

11. The process of claim 10 wherein the extractant and surfactant are premixed prior to injection into the vessel.

12. The process of claim 11 wherein the mixture is injected at the rate of from 0.2 to about 0.4 pounds per pound of steam.

13. A process for removal, sufficient to allow human entry into a chemical or refining process vessel for repair and maintenance of benzene contamination from a vessel which has been taken out of service and drained, comprising the steps of:

injecting into the vessel, for a period of time sufficient to reduce contamination by presence of chemical residues to allow safe exposure to humans, steam at a temperature of up to about 375° F.;

injecting into the vessel, in the presence of the steam, from about 0.1 pounds to about 0.2 pounds per pound of steam of a terpene as an extractant for the benzene from the chemical residue adhering to the interior surfaces of the vessel, such extractant having a boiling point of up to about the temperature of the steam being injected;

injecting into the vessel, in the presence of the steam from about 0.0003 to about 0.005 pounds per pound of steam of an nonionic, anioic, cationic or amphoteric surfactant or mixtures thereof having an HLB of afrom about 7.5 to about 12, provided, however, when both the extractant and surfactant are present, they are present in a ratio of from about 0.5 to about 30 pounds of extractant per pound of surfactant;

allowing steam, extractant and surfactant to condense on internal surfaces within the vessel and invade interstices of scale on the surface to extract and trap benzene contaminants and form a pool of condensed liquids and chemical residues; and removing the condensed liquid and chemical residue from the vessel.

14. A process for removal, sufficient to allow human entry into a vessel for repair and maintenance, of benzene contamination from a vessel which has been taken out of service and drained, comprising the steps of:

connecting a circulation loop from the bottom of the vessel to the top of the vessel;

partially filling the vessel with sufficient water to provided continuous circulation;

circulating the water through the loop at a rate sufficient to produce uniform flow through the vessel;

injecting steam into the vessel to heat the water to a temperature of from about 165° F. to about 230° F.;

injecting into the vessel an effective amount of, as an extractant for the benzene in the vessel, a terpene having a boiling point of up to about the temperature of the steam being injected;

injecting into the vessel an effective amount, as an emulsifying agent for contaminants, of a surfactant having an HLB of from about 6 to about 18, provided, however, the extractant and surfactant are present in a ratio of from about 0.5 to about 30 pounds of extractant per pound of surfactant;

circulating the heated water, extractant, and surfactant for from about 1½ to about 7 hours; and removing the condensed liquid with benzene trapped therein from the vessel.

15. The process of claim 14 which includes injecting the extractant simultaneously with the steam into the vessel.

16. The process of claim 15 wherein the concentration of the extractant and surfactant mixture is at a concentration of from about 1½% to about 5%.

17. The process of claim 14 which includes the steps of:

halting the steam injection when the pressure within the vessel reaches from about 20 to about 60 psig; and holding the steam and vaporized extractant and surfactant within the vessel for a time sufficient to allow the condensation to occur.

18. The process of claim 14 wherein from about 0.06 to about 0.3 pounds of extractant per pound of steam and from about 0.001 to about 0.01 pounds of surfactant are injected per pound of steam.

19. The process of claim 14 wherein the circulation rate is from about 800 to about 1400 gallons per minute.

20. A process for removal of benzene contamination trapped in scale residue of a process vessel or equipment comprising the steps of:

contacting the scale on surfaces of the vessel or equipment with an aqueous liquid cleaning mixture or vapors thereof, said mixture containing
an effective amount of terpene extractant,
an effective amount of surfactant,
each having a vapor pressure at treating conditions sufficiently high to disperse such extractant and surfactant through the vessel at such conditions; and heating the cleaning mixture up to a temperature of from about 165° F. to about 230° F. to disperse such extractant and surfactant through the process equipment to invade interstices of the scale residue, extract the benzene, break down the scale and entrap the benzene and scale residue into the cleaning mixture.

21. The process of claim 20 wherein the cleaning mixture is recycled during treating conditions.

22. A process for decontaminating process vessels and auxiliary equipment in fluid communication therewith to remove benzene contamination trapped in scale on internal surfaces to permit human entry for repair and maintenance comprising the steps of:

contacting the benzene contaminated scale and surfaces, at a temperature of from about 160° F. to about 230° F. with an aqueous mixture containing a terpene extractant and a surfactant having an HLB of from about 6 to about 18;

circulating the mixture through the process vessels in contact with the surfaces to allow invasion of interstices of the scale by the mixture for a time sufficient to break down the scale and entrap the benzene contaminants in the mixture; and dispersing such extractant and surfactant as vapors through the process vessels to condense on surfaces of the vessels to break down scale and entrap the layers and scale residue in the mixture; and separating the mixture from the surface to remove the benzene contaminants from the vessels and equipment with the mixture.

* * * * *